US006106173A

United States Patent [19]

Suzuki et al.

[11] Patent Number: 6,106,173

[45] Date of Patent: Aug. 22, 2000

[54] IMAGE-FORMING SYSTEM INCLUDING A PLURALITY OF THERMAL HEADS AND AN IMAGE-FORMING SHEET WITH A PLURALITY OF TYPES OF MICRO-CAPSULES

[75] Inventors: Minoru Suzuki, Tochigi; Hiroshi Orita; Hiroyuki Saito, both of Saitama; Katsuyoshi Suzuki; Koichi Furusawa, both of Tokyo, all of Japan

[73] Assignee: Asahi Kogaku Kogyo Kabushiki Kaisha, Tokyo, Japan

[21] Appl. No.: 09/263,260

[22] Filed: Mar. 5, 1999

[30] Foreign Application Priority Data

Mar. 6, 1998 [JP] Japan ..... 10-073454

[51] Int. Cl.[7] ..... B41J 2/32; B41J 3/54

[52] U.S. Cl. ..... 400/120.02; 400/241.2; 400/149; 400/82; 347/172; 347/173

[58] Field of Search ..... 347/212, 172, 347/173; 400/241.2, 120.01, 120.02, 120.04, 124.08, 124.09, 124.1, 149, 82; 428/321.5

[56] References Cited

U.S. PATENT DOCUMENTS

| | | | |
|---|---|---|---|
| 4,399,209 | 8/1983 | Sanders et al. | 430/138 |
| 4,440,846 | 4/1984 | Sanders et al. | 430/138 |
| 4,644,376 | 2/1987 | Usami et al. | 503/215 |
| 4,660,052 | 4/1987 | Kaiya et al. | 400/82 |
| 4,946,297 | 8/1990 | Koike et al. | 400/82 |
| 4,977,410 | 12/1990 | Onuki et al. | 347/191 |
| 5,132,704 | 7/1992 | Nakagawa | 400/124.08 |
| 5,825,985 | 10/1998 | Asai et al. . | |
| 6,022,648 | 2/2000 | Jacobson et al. | 347/250 |

FOREIGN PATENT DOCUMENTS

| | | | |
|---|---|---|---|
| 61-20766 | 1/1986 | Japan | 400/82 |
| 63-128956 | 6/1988 | Japan | 400/82 |
| 4-4960 | 1/1992 | Japan . | |
| 9-207365 | 8/1997 | Japan . | |

*Primary Examiner*—John S. Hilten
*Assistant Examiner*—Daniel J. Colilla
*Attorney, Agent, or Firm*—Greenblum & Bernstein P.L.C.

[57] ABSTRACT

A plurality of thermal heads for different colors, are disposed in parallel in a line-printing direction, being offset with respect to each other in a transport direction along which an image-forming sheet is moved via a conveyer path. The image forming sheet is a pressure/temperature-sensitive sheet or a temperature-sensitive sheet. The thermal heads are moved in the line-printing direction. Adjacent-opposing ends of adjacent thermal heads are separated in the line-printing direction, and overlap in the transport direction. The thermal heads are controlled so as to simultaneously generate image-pixels on the image-forming sheet. The printing speed is high due to a plurality of colors being simultaneously printed. The thermal heads are used as part of pressure applying unit. The pressure applying unit is provided for selectively applying predetermined pressure to the micro-capsules, when the image-forming sheet is a pressure/temperature-sensitive sheet. The thermal heads can also be applied to a high-speed printing of a mono-chrome image on the temperature-sensitive sheet.

11 Claims, 8 Drawing Sheets

IMAGE-FORMING SYSTEM INCLUDING A PLURALITY OF THERMAL HEADS AND AN IMAGE-FORMING SHEET WITH A PLURALITY OF TYPES OF MICRO-CAPSULES

BACKGROUND OF THE INVENTION

1. Field of the Invention

The present invention relates to an image forming system for forming an image on an image-forming sheet, coated with a layer of micro-capsules filled with dye or ink, by selectively breaking or squashing the micro-capsules in the layer of micro-capsules. Further, the present invention relates to such an image-forming sheet and an image-forming apparatus, which forms an image on the image-forming sheet, used in the image-forming system.

2. Description of the Related Art

An image-forming system per se is known, and uses an image-forming sheet coated with a layer of micro-capsules filled with dye or ink, on which an image is formed by selectively breaking or squashing micro-capsules in the layer of micro-capsules.

For example, in a conventional image-forming system using an image-forming sheet coated with a layer of micro-capsules in which a shell of each micro-capsule is formed from a photo-setting resin, an optical image is formed as a latent image on the layer of micro-capsules by exposing it to light rays in accordance with image-pixels signals. Then, the latent image is developed by exerting pressure on the layer of micro-capsules. Namely, the micro-capsules, which are not exposed to the light rays, are broken and squashed, whereby dye or ink seeps out of the broken and squashed micro-capsules, and thus the latent image is visually developed by the seepage of dye or ink.

Of course, in this conventional image-forming system, each of the image-forming sheets must be packed so as to be protected from being exposed to light, resulting in wastage of materials. Further, the image-forming sheet must be handled such that they are not subjected to excess pressure due to the softness of unexposed micro-capsules, resulting in an undesired seepage of dye or ink.

Also, a color-image forming system, using an image-forming sheet coated with a layer of micro-capsules filled with different color dye or ink, is known. In this system, the respective different colors are selectively developed on an image-forming sheet by applying specific temperatures to the layer of color micro-capsules. Nevertheless, it is necessary to fix a developed color by irradiation, using light of a specific wavelength. Accordingly, this color-image-forming system is costly, as an additional irradiation apparatus for the fixing of a developed color is needed, and electric power consumption is increased due to the additional irradiation apparatus. Also, since a heating process for the color development and an irradiation process for the fixing of a developed color must be carried out with respect to each color, hinder a quick formation of a color image on the color-image-forming sheet is hindered.

SUMMARY OF THE INVENTION

Therefore, an object of the present invention is to provide an image-forming system of a small size, using an image-forming sheet coated with a layer of micro-capsules filled with dye or ink, in which an image can be quickly formed on the image-forming sheet at a low cost, without producing a large amount of waste material.

In accordance with an aspect of the present invention, there is provided an image-forming system comprising an image-forming sheet that includes a layer of a plurality of types of micro-capsules, each type of micro-capsules being squashed under a predetermined pressure and temperature, the predetermined pressure and the predetermined temperature of one type of micro-capsules being different from those of other types of micro-capsules, and a conveyer for conveying the image-forming sheet in a conveyer direction. A plurality of thermal heads corresponding to the types of micro-capsules is also included that heats the corresponding types of micro-capsules. The thermal heads are staggeredly aligned in the conveyer direction, with neighboring ends of each neighboring pair of the thermal heads being positioned adjacent to each other. A pressure applying unit that selectively applies pressure corresponding to the predetermined pressure to said micro-capsules when the image-forming sheet is a pressure/temperature sensitive sheet. A moving apparatus is also included that moves the thermal heads in a direction perpendicular to the conveyer direction. A driving unit is also included that controls each of the thermal heads by a control signal corresponding to a partial image of the image to be developed by the thermal head so that all of the thermal heads simultaneously develop the partial image.

Preferably, the thermal heads are used as the pressure applying unit, with each applying a pressure on said micro-capsules different from a pressure applied by the other thermal heads corresponding to said predetermined pressure.

Preferably, the neighboring ends of each neighboring pair of the thermal heads are separated from one another and overlap in the direction perpendicular to the conveyer direction.

Preferably, a number of the thermal heads is three corresponding to colors of cyan, magenta and yellow. The number of the thermal heads may be four corresponding to colors of cyan, magenta, yellow and black.

Preferably, the thermal heads comprise a plurality of heating elements having a predetermined resistance equal to resistances of heating elements of other thermal heads, and each of the thermal heads is differently controlled from other thermal heads so that each of the thermal heads is heated to the predetermined temperature.

Preferably, each of the thermal heads comprises a plurality of heating elements having predetermined resistance, and each thermal head is controlled to have a heating time equal to a heating time of other thermal heads. The resistance of the heating elements of each of the thermal heads is adjusted so that each thermal head is heated to the predetermined temperature.

Preferably, the control signal comprises a strobe signal for determining a heating time and a signal corresponding to image-pixel data.

Preferably, each type of said micro-capsules comprises a wall of glass-transition temperature and thickness different from those of the types of micro-capsules.

In accordance with an aspect of the present invention, there is provided an image-forming system comprising a conveyer that conveys the heat-sensitive sheet in a conveyer direction, a plurality of thermal heads that heat a heat-sensitive sheet. The thermal heads extends substantially along the conveyer direction and are substantially serially aligned one after another along the conveyer direction, neighboring ends of each neighboring pair of the thermal heads being positioned adjacent to each other. A moving apparatus for moving the thermal heads in a direction perpendicular to the conveyer direction is also included. A driving unit is also included that controls each of the thermal heads by a control signal corresponding to a partial image of the image to be developed by the thermal head so that all of the thermal heads simultaneously develop the partial image.

Preferably, the image is automatically judged by a CPU whether it is color image or a mono-chrome image.

BRIEF DESCRIPTION OF THE DRAWINGS

The present invention will be better understood from the description of the preferred embodiments of the invention set forth below together with the accompanying drawings, in which.

DESCRIPTION OF THE PREFERRED EMBODIMENTS

Hereinafter, the preferred embodiment of the present invention are described with reference to the attached drawings.

Figure 1:
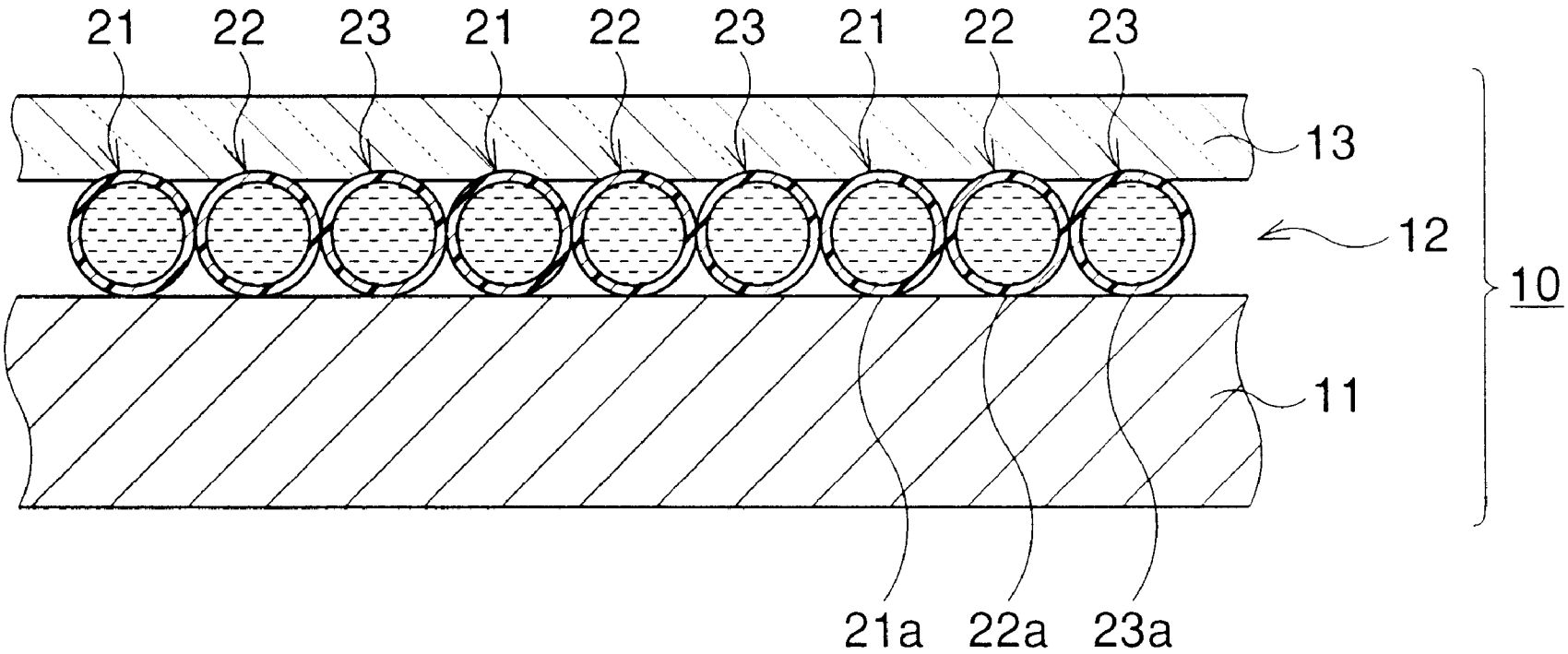
FIG. 1 is an enlarged cross-sectioned elevational view showing an image-forming sheet of an embodiment.

FIG. 1 shows an embodiment of an image-forming sheet, generally indicated by reference 10, which is used in an image-forming system according to the present invention. In the embodiment, the image-forming sheet 10 is produced in the form of a paper sheet. In particular, the image-forming sheet 10 comprises a sheet of paper 11, a layer of micro-capsules 12, and a sheet of protective transparent film 13 covering the layer of micro-capsules 12.

In the embodiment, the layer of micro-capsules 12 is formed from three types of micro-capsules: a first type of micro-capsules 21 filled with cyan liquid dye or ink, a second type of micro-capsules 22 filled with magenta liquid dye or ink, and a third type of micro-capsules 23 filled with yellow liquid dye or ink, and these micro-capsules 21, 22 and 23 are uniformly distributed in the layer of micro-capsules 12.

Figure 2:
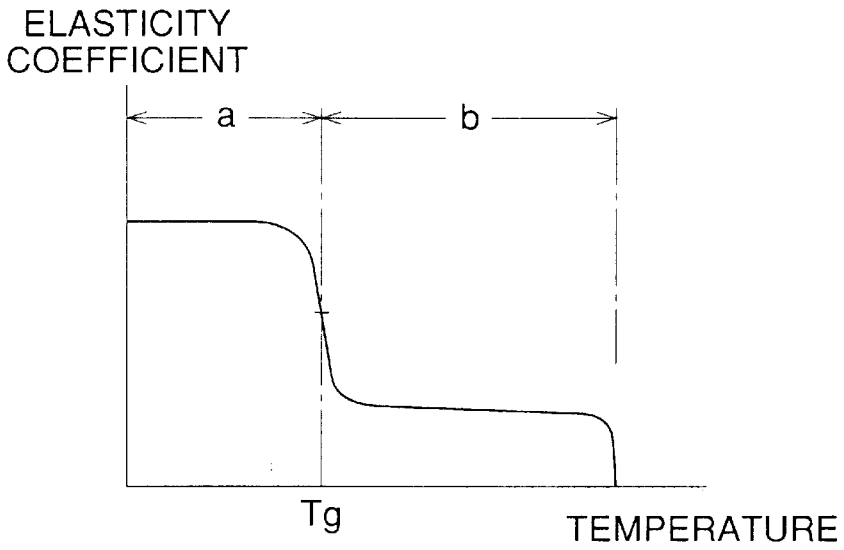
FIG. 2 is a graph showing a characteristic relationship between phase-transition temperature and elasticity coefficient of a capsule wall of a micro-capsule of the embodiment.

In general, as shown in a graph of FIG. 2, the shape memory resin exhibits a coefficient of longitudinal elasticity, which abruptly changes at a glass-transition temperature boundary Tg. In the shape memory resin, micro-Brownian motion is frozen in a low temperature area "a", which is lower than the glass-transition temperature Tg, and thus the shape memory resin exhibits a glass-like phase. On the other hand, micro-Brownian motion of the molecular chain becomes increasingly energetic in a high-temperature area "b", which is higher than the glass-transition temperature Tg, and thus the shape memory resin exhibits a rubber elasticity.

The shape memory resin is named due to the following shape memory characteristic: after a mass of the shape memory resin is worked into a shaped article in the low-temperature area "a", when such a shaped article is heated over the glass-transition temperature Tg, the article becomes freely deformable. After the shaped article is deformed into another shape, when the deformed article is cooled to below the glass-transition temperature Tg, the other shape of the article is fixed and maintained. Nevertheless, when the deformed article is again heated to above the glass-transition temperature Tg, without being subjected to any load of external force, the deformed article returns to the original shape. The shape memory resin is a resin such as polynorbornene, trans-1, 4-polyisoprene, polyurethane and so forth.

Figure 3:
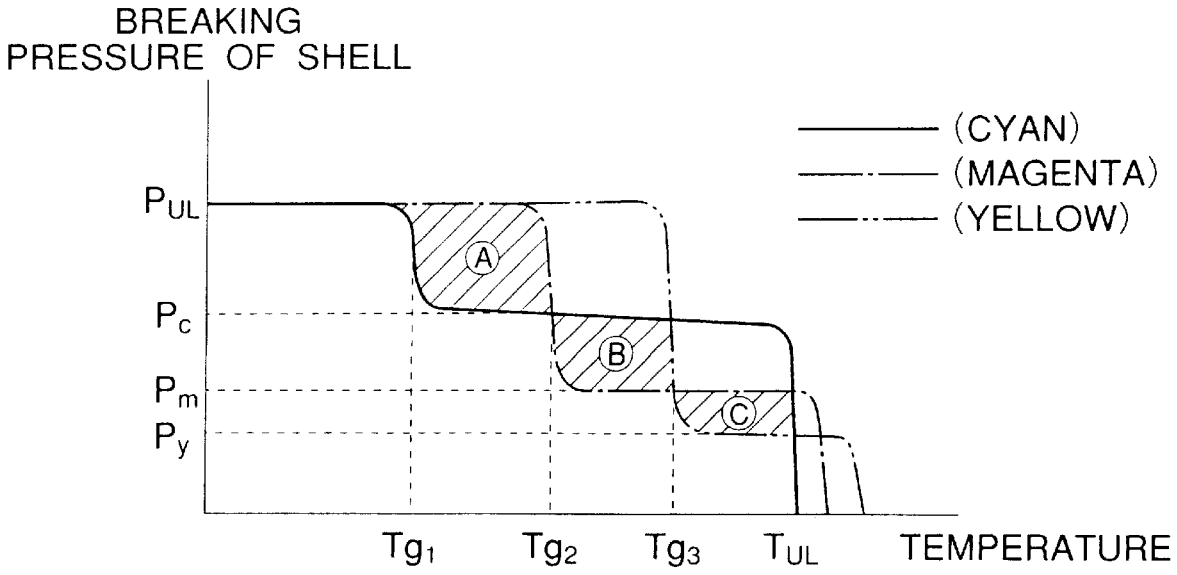
FIG. 3 is a diagram showing a characteristic relationship between temperature and breaking pressure of the capsule wall of the different types of micro-capsules of the embodiment.

As shown in a graph of FIG. 3, the micro-capsules 21 are prepared so as to exhibit a characteristic breaking pressure having a glass-transition temperature Tg1, indicated by a solid line; the micro-capsules 22 are prepared so as to exhibit a characteristic breaking pressure having a glass-transition temperature Tg2, indicated by a single-chained line; and the micro-capsules 23 are prepared so as to exhibit a characteristic breaking pressure having a glass-transition temperature Tg3, indicated bv a double-chained line. For example, the glass-transition temperature Tg1 may be set to a temperature selected from a range between 65° C. and 70° C., and the temperature Tg2 and Tg3 are set so as to increase in turn by 40° C. from the temperature set for Tg1. The glass-transition temperature Tg1, Tg2 and Tg3 are 65° C., 105° C. and 145° C., respectively, in this embodiment.

Figure 4:
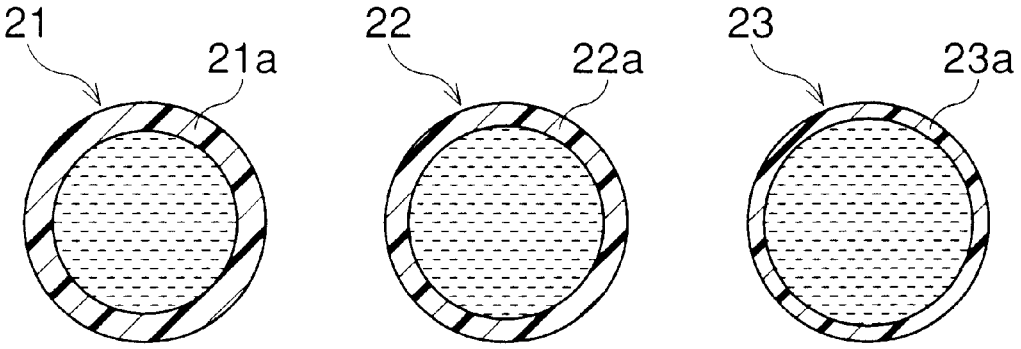
FIG. 4 is a cross-sectional view showing different types of micro-capsules utilized in the embodiment.

As shown in FIG. 4, the thickness of the micro-capsule wall 21*a* of cyan micro-capsules 21 is larger than the thickness of the micro-capsule wall 22*a* of magenta micro-capsules 22, and the thickness of the micro-capsule wall 22*a* of magenta micro-capsules 22 is larger than the thickness of the micro-capsule wall 23*a* of yellow micro-capsules 23.

The wall thickness of the cyan micro-capsules 21 is selected such that each cyan micro-capsule 21 is broken and compacted under a breaking pressure p1 that lies between a critical breaking pressure Pc and an upper limit pressure $P_{UL}$, when each micro-capsule 21 is heated to a temperature T1 between the glass-transition temperatures Tg1 and Tg2, as shown by a hatched area "A" (FIG. 3); the wall thickness of the magenta micro-capsules 22 is selected such that each magenta micro-capsule 22 is broken and compacted under a breaking pressure p2 that lies between a critical breaking pressure Pm and the critical breaking pressure Pc, when each micro-capsule 22 is heated to a temperature T2 between the glass-transition temperatures Tg2 and Tg3, as shown bv a hatched area "E"; the wall thickness of the yellow micro-capsules 23 is selected such that each yellow micro-capsule 23 is broken and compacted under a breaking pressure p3 that lies between a critical breaking pressure Py and the critical breaking pressure Pm, when each micro-capsule 23 is heated to a temperature T3 between the glass-transition temperature Tg3 and an upper limit temperature $T_{UL}$ as shown by a hatched area "C".

Note, when the glass-transition temperatures Tg1, Tg2 and Tg3 are set as mentioned above, the upper limit temperature $T_{UL}$ may be set to a temperature selected from a range between 185° C. and 190° C. Also, for example, the breaking pressure Py, Pm, Pc and $P_{UL}$ are set to 0.02, 0.2, 2.0 and 20 Mpa, respectively.

Figure 5:
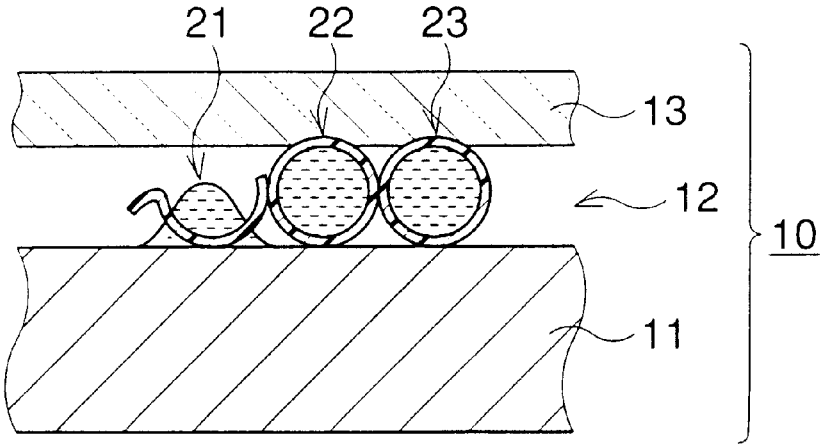
FIG. 5 is a conceptual cross-sectioned elevational view showing a micro-capsule being broken in the embodiment.

For example, if the selected heating temperature (T1) and breaking pressure (p1) fall within a hatched cyan area A, only the cyan micro-capsules 21 are broken and squashed, as shown in FIG. 5. Also, if the selected heating temperature (T2) and breaking pressure (p2) fall within the hatched magenta area B, only the magenta micro-capsules 22 are broken and squashed. Further, if the selected heating temperature (T3) and breaking pressure (p3) fall within the hatched yellow area C, only the yellow micro-capsules 23 are broken and squashed.

In FIG. 5, the cyan dye or ink in the broken micro-capsules is discharged and the color cyan is developed. The broken walls 21*a* of the broken micro-capsules 21 remain on the sheet 11, however, the color development of the ink or dye is not influenced by the walls 21*a* due to the walls 21*a* being very thin. The walls 22*a* and 23*a*, when broken, similarly do not influence a development of seeped magenta and yellow ink or dye. The walls 21*a* to 23*a* and the sheet 11 are colored white in this embodiment.

As is apparent from the foregoing, by suitably selecting a heating temperature and a breaking pressure, which should be exerted on the image-forming sheet 10, it is possible to selectively break and squash the cyan, magenta and yellow micro-capsules 21, 22 and 23. Therefore, a color image can be generated by synthesizing a produced cyan image, a magenta image and a yellow image.

Figure 6:
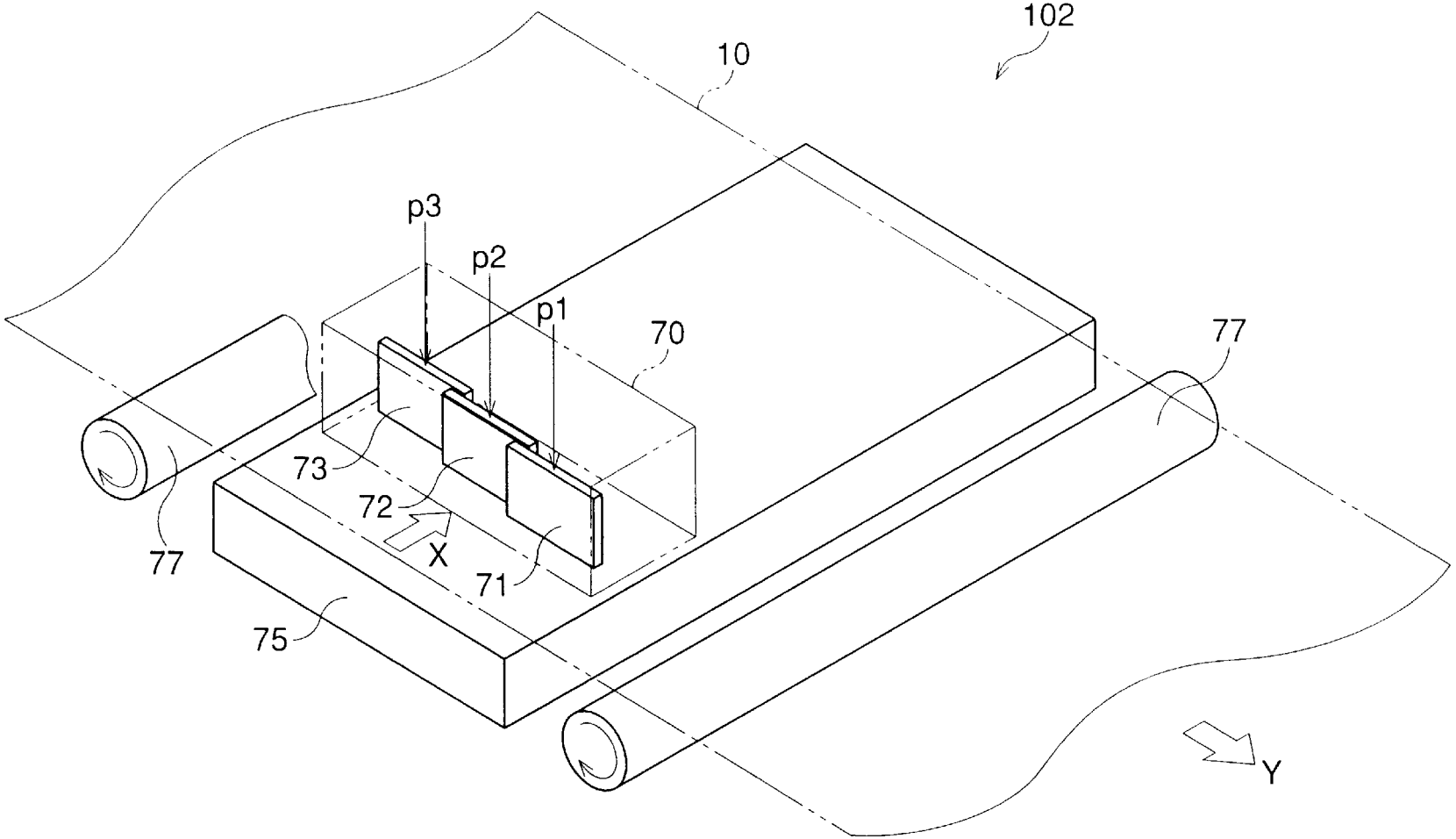
FIG. 6 is a perspective partially exploded view showing a high-resolution color printer for recording an image of the embodiment.

FIG. 6 schematically shows an embodiment of a color printer 102 as an image-forming system according to the present invention, which is constituted as a thermal serial printer to form a color image on the image-forming sheet 10.

The printer includes a carriage 70 and a flat platen 75 under the carriage 70, that operates in conjunction with the carriage 70 for exerting the heat and the pressure on the micro-capsules 21, 22 and 23 in the layer 12 of the image forming sheet 10. Three thermal heads 71, 72 and 73 are provided in the carriage 70 for heating the micro-capsules 21, 22 and 23, respectively. The thermal heads 71, 72 and 73 are resiliently biased toward the flat platen 75 with the breaking pressures p1, p2 and p3, respectively, so as to press the image-forming sheet 10 against the flat platen 75.

The image-forming sheet 10 is interposed between the carriage 70 and the flat platen 75 during a printing operation, and is substantially horizontally conveyed in a transport direction Y, by a pair of conveyer rollers 77 positioned at opposite sides of the flat platen 75 in the transport direction Y. The conveyer rollers 77 extend in a line-printing direction X perpendicular to the transport direction Y and rotate to convey the image-forming sheet 10 in the direction Y.

Figure 7:
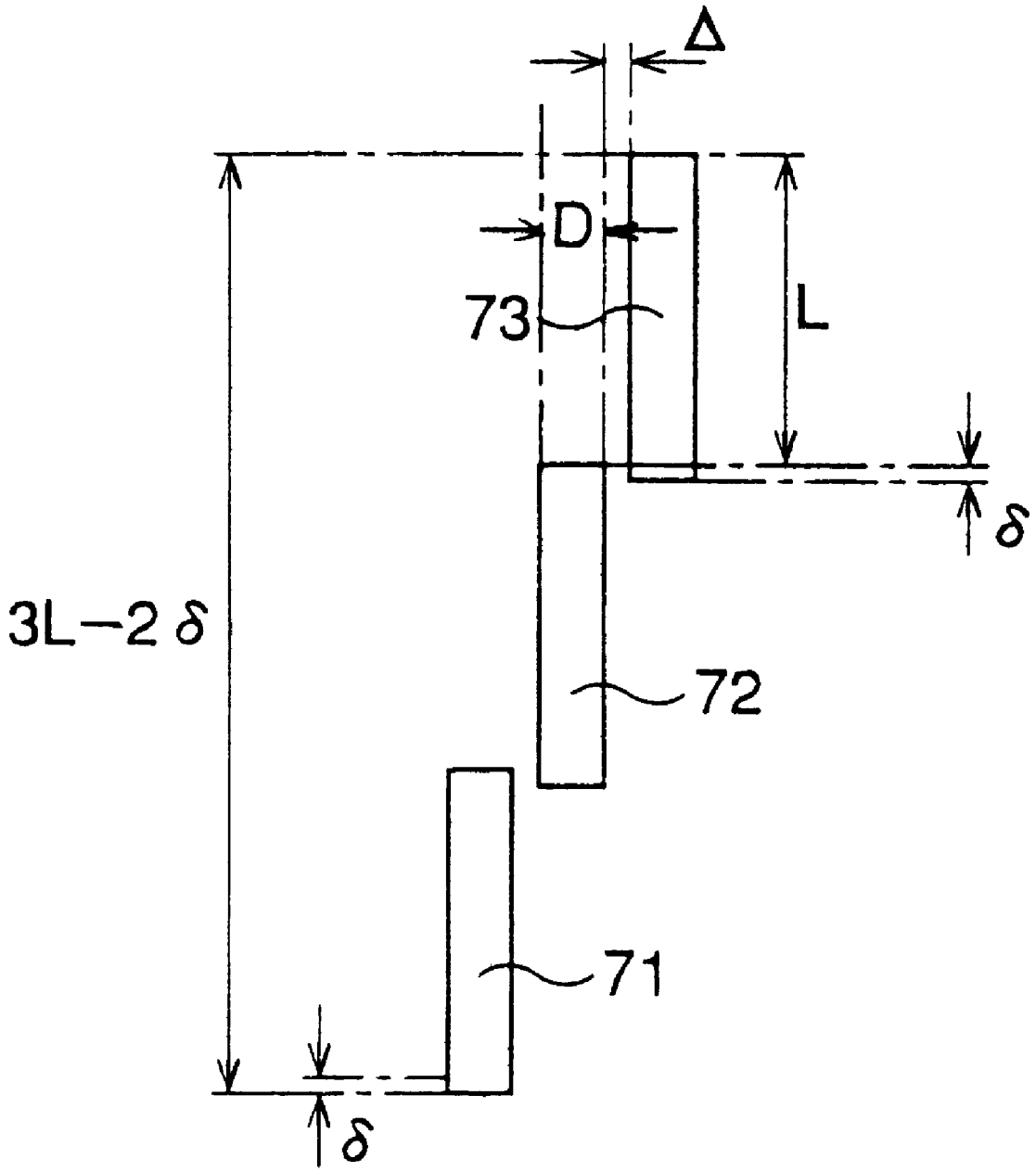
FIG. 7 is a plan view showing an arrangement of thermal heads of the embodiment.

As shown in FIGS. 6 and 7, the thermal heads 71, 72 and 73 extend in the transport direction Y and are substantially serially aligned in the line-printing direction X, being uniformly staggered from thermal head 71 in a reverse direction of the transport direction Y. The carriage 70 is moved reciprocally by a moving mechanism in a well-known manner, not shown, in the line-printing direction X and in a reverse direction of the direction X. During the initial movement in the direction X, the carriage 70 generates the cyan, magenta and yellow images by the thermal heads 71, 72 and 73, respectively. Since the three thermal heads 71, 72 and 73 extend in the transport direction Y and are simultaneously moved, the three colors are not only simultaneously printed, but a plurality of lines of each color are also simultaneously printed. In other words, simultaneously, on each row of the image-forming sheet 10 corresponding to the thermal heads 71, 72 and 73, a plurality of lines of a different primary color is printed.

Due to the aforementioned uniform staggering, whereby adjacent ends of the thermal heads 71, 72 and 73 partially overlap each other in the Y direction, the generated heat from each of the thermal heads 71, 72 and 73 is not transferred to a proximate thermal head (71, 72, 73), thereby not affecting a temperature-control of the proximate thermal heads (71, 72, 73). If an offset of one thermal head with respect to the proximate thermal heads (71, 72, 73) is large, an area occurs at both lateral ends (i.e. margin areas) of the image-forming sheet 10 where the image-pixels cannot be printed in full-color. The partial overlap of the adjacent ends prevents lateral areas between adjacent thermal heads (71, 72, 73) being inconsistently printed, i.e. not full color.

The printing is performed while the carriage 70 is moving in the line-printing direction X. However, it is possible to perform a printing during the reciprocal movement of the carriage 70 in the reverse direction.

As shown in FIG. 3, a relationship between the heating temperatures T1, T2 and T3 applied to the capsule layer 12 of the recording sheet 10 by the thermal heads 71, 72 and 73, and the glass-transition temperatures Tg1, Tg2 , Tg3 and $T_{UL}$ is $T1<T2<T3$, as well as, $Tg1<T1<Tg2<T2<Tg3<T3<T_{UL}$. A relationship between the breaking pressure p1, p and p3 exerted on the capsule layer 12 of the recording sheet 10 by the thermal heads 71, 72 and 73, and the critical breaking pressures Pc, Pm, Py and $P_{UL}$ is $p3<p2<p1$, as well as, $Py<p3<Pm<p2<Pc<p1<P_{UL}$.

The image-forming sheet 10 is subjected to pressure p1 in the range between the critical breaking pressure Pc and the upper limit pressure $P_{UL}$ when passing between the first thermal head 71 and the flat platen 75; the image-forming sheet 10 is subjected to pressure p2 in the range between the critical breaking pressures Pm and Pc when passing between the second thermal head 72 and the flat platen 75; and the image-forming sheet 10 is subjected to pressure p3 in the range between the critical breaking pressures Py and Pm when passing between the third thermal head 73 and the flat platen 75. When the cyan ink or dye is to be discharged (as in FIG. 5, for example), the thermal head 71 locally heats the micro-capsules 21, 22 and 23 to a temperature T1 in the range between glass-transition temperatures Tg1 and Tg2, being in the hatched area A (FIG. 3); when magenta ink or dye is to be discharged, the thermal head 72 locally heats the micro-capsules 21, 22 and 23 to a temperature T2 in the range between glass-transition temperatures Tg2 and Tg3, being in the hatched area B; and when yellow ink or dye is to be discharged, the thermal head 73 locally heats the micro-capsules 21, 22 and 23 to a temperature T3 in the range between glass-transition temperature Tg3 and the upper limit temperature $T_{UL}$, being in the hatched area C.

Figure 8:
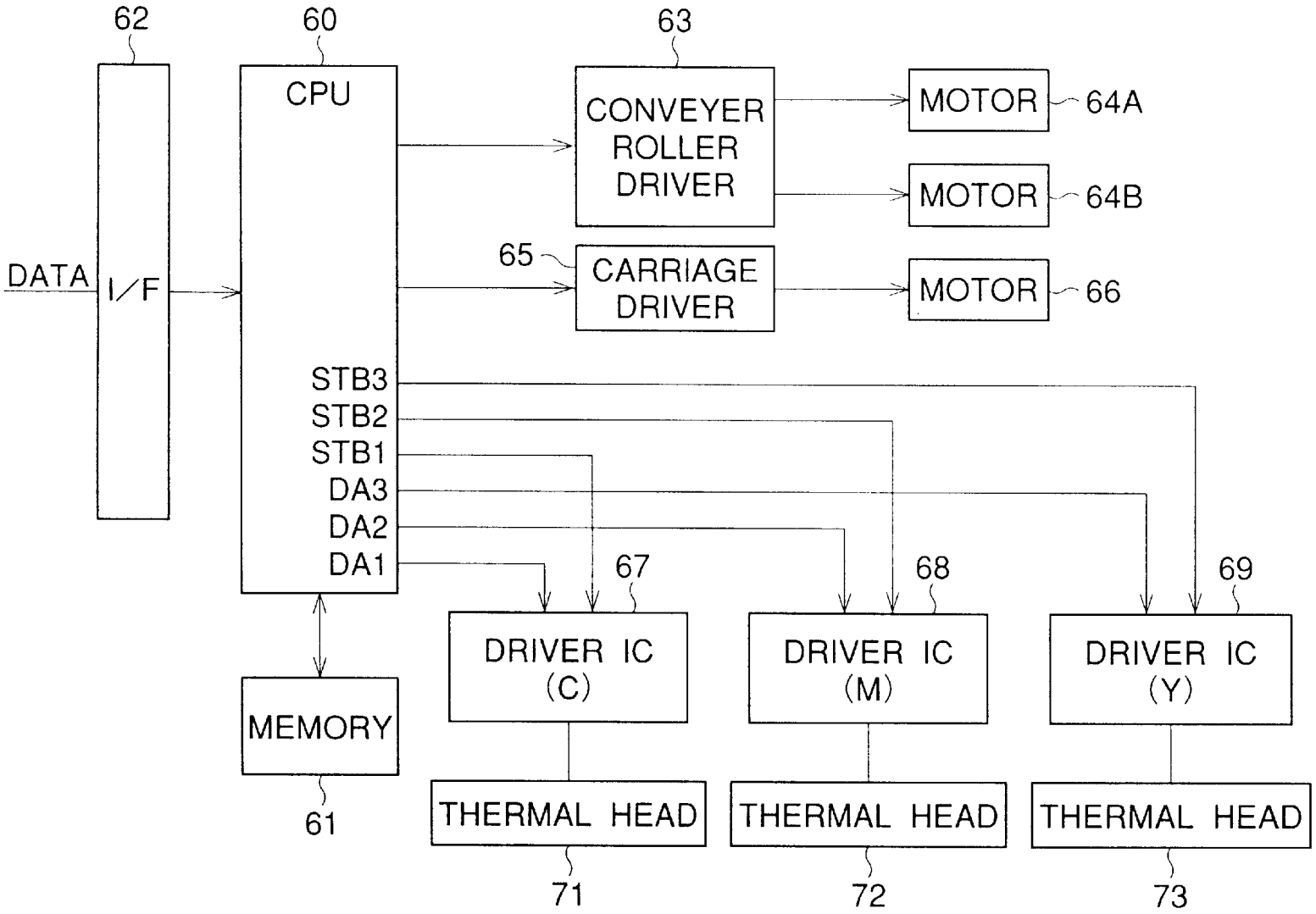
FIG. 8 is a block diagram showing a control system of the printer of the embodiment.

FIG. 8 shows a schematic block diagram of the control circuit for the printer 102. As shown in this drawing, the control circuit comprises a central processing unit (CPU) 60, which receives digital color image-pixel signals (Data) from a personal computer or a word processor (not shown) through an interface circuit (I/F) 62, and the received digital color image-pixel signals, i.e. digital cyan image-pixel signals, digital magenta image-pixel signals and digital yellow image-pixel signals, are stored as a bit-map of each color component in a memory 61.

Also, the control circuit is provided with a conveyer roller motor driver 63 for driving two electric motors 64A and 64B, which are used to rotate the conveyer rollers 77, respectively. A carriage driver 65 is also connected to the CPU 60 for driving an electric motor 66, which moves the carriage reciprocally in the line-printing direction X. In this embodiment, each of the motors 64A, 64B and 66 is a stepping motor, which is driven in accordance with a series of drive pulses outputted from the drivers 63 and 65 which in turn are controlled by the CPU 60.

The thermal heads 71, 72 and 73 are driven by driver ICs 67, 68 and 69, respectively. The driver ICs 67, 68 and 69 are controlled by control signals DA1, DA2 and DA3, and by strobe signals STB1, STB2 and STB3, respectively, which are output from the CPU 60.

The strobe signal STB1, STB2 and STB3 in this embodiment are square wave pulses of equal pulse width enabling a predetermined heating period to operate. The heating elements of the respective thermal heads 71, 72 and 73 have predetermined resistances differing between the thermal heads 71, 72 and 73, such that, the heating temperature T1, T2 and T3 can be realized over the heating period. Further, each thermal head 71, 72 and 73 is independently controlled by the CPU 60 to heat to a respective temperature T1, T2 and T3.

In a modification to the embodiment, the strobe signals STB1, STB2 and STB3 are square wave pulses of predetermined pulse width, and the heating elements of the thermal heads 71, 72 and 73 have equal resistances. The heating temperature T1, T2 and T3 are thus generated by operating the respective heating elements in accordance with the strobe signals STB1, STB2 and STB3, i.e. the strobe signal STB1, corresponding to thermal head 71, would have a shorter pulse width than strobe signal STB2, corresponding to thermal head 72, whereby thermal head 71 would operate for a shorter period than thermal head 72, heating to the lower heating temperature T1. Likewise, the strobe signal STB2, corresponding to thermal head 72, would have a shorter pulse width than strobe signal STB3, corresponding to thermal head 73, whereby thermal head 72 would operate for a shorter period than thermal head 73, heating to the lower heating temperature T2. Thermal head 73 would thus operate for the longest period, corresponding to strobe signal STB3, such that heating temperature T3 is reached.

The control signal DA1 corresponds to cyan image-pixel signals; the control signal DA2 corresponds to magenta image-pixel signals; and the control signal DA3 corresponds to yellow image-pixel signals. The thermal heads 71, 72 and 73 are simultaneously heated for discharging the respective cyan, magenta and yellow ink or dye at positions shifted in the transport direction Y and the line-printing direction X.

Three thermal heads are provided corresponding to the primary colors cyan, magenta and yellow in the above embodiment, however, a greater or lesser number of thermal heads may be utilized. For example, the number of the thermal heads is four when a black image is to be formed in addition to the cyan, magenta and yellow images, and the image-forming sheet 10 may be altered or modified accordingly.

Figure 9:
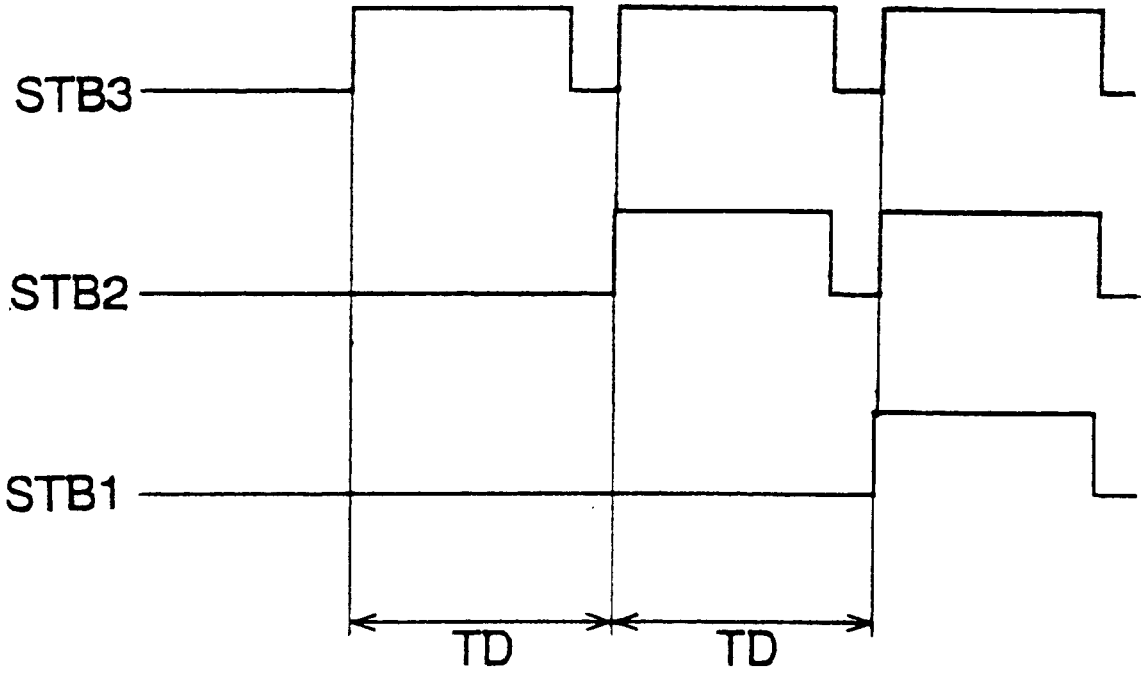
FIG. 9 is a timing chart showing a strobe signal of the control system in FIG. 8 for driving the thermal heads.

The length of each thermal head 71, 72 and 73 is L (FIG. 7), a distance between adjacent thermal heads 71, 72 and 73 in the line-printing direction X is Δ, and thermal head 72 is offset in the transport direction Y from being serially-aligned with thermal head 71 in the line-printing direction X by a distance (L-δ), and, similarly, thermal head 73 is offset from being serially-aligned with thermal head 72 in the line-printing direction X by a distance (L-δ). Therefore, as shown in FIG. 7, the thermal heads 71, 72 and 73 overlap each other, in the transport direction Y, by an overlap length δ. In an overlap area of the thermal heads 71, 72 and 73, corresponding to the overlap length δ, the image may be generated on the image-forming sheet 10 twice due to the heating elements of the thermal heads 71, 72 and 73 extending along an entire bottom surface of the respective thermal heads (71, 72, 73), or the image may be generated once in the overlap area due to the heating elements of one thermal head (71, 72 or 73) of a pair of adjacent thermal heads (71, 72, 73) not being disposed on a portion of the bottom surface corresponding to the overlap length δ. The control signals DA1, DA2 and DA3 correspond to different portions of the image to be generated due to the offset of the thermal heads 71, 72 and 73 by the distance (Δ+D), where Δis a separation distance between adjacent thermal heads 71, 72 and 73, and D is a width of each thermal head 71, 72 and 73. The image-forming sheet 10 is intermittently moved in the transport direction Y to allow successive printing of the three colors cyan, magenta and yellow. The intermittent movement distance is (L-δ). Due to the staggered alignment of the thermal heads 71, 72 and 73, during a printing operation of the image, the strobe signals STB1, STB2 and STB3 are supplied to the thermal heads 71, 72 and 73, respectively, with a delay time TD, measured between a leading edge of an initial pulse of consecutive strobe signals (STB1, STB2, STB3), as shown in FIG. 9, corresponding to the offset distance (Δ+D). Thus, to prevent a margin area of the recording sheet 10 from being printed in, the strobe signal STB3 is supplied to thermal head 73 with no delay and a yellow image printing commences in accordance with control signal DA3; then strobe signal STB2 is supplied to thermal head 72 after the delay period TD that allows the carriage 70 to move a distance (Δ+D) in the line-printing direction X and for the thermal head 72 to move out of the margin area, and a magenta image printing commences in accordance with control signal DA2; then strobe signal STB1 is supplied to thermal head 71 with a delay period 2TD that allows the carriage 70 to move a distance 2(Δ+D) in the line-printing direction X and for the thermal head 71 to move out of the margin area, and a cyan image printing commences in accordance with control signal DA1. When a movement speed of the carriage 70 in the direction X is V, the delay period TD is ((Δ+D)/V).

Each thermal head 71, 72 and 73 comprises a plurality of heating elements, aligned serially along the length of the bottom surface of the respective thermal head (71, 72, 73). During a printing operation, the strobe signals STB1, STB2 and STB3 are output as regular pulses, and each heating element of a respective thermal head (71, 72, 73) is controlled to print a pixel of the image by the corresponding control signal (DA1, DA2, DA3) output from the CPU 60 and generated in accordance with the digital image-pixel signals input to the interface 62. In this embodiment, the heating times of the heating elements are equal, so that the heating temperatures T1, T2 and T3 for breakage of the micro-capsules 24, 25 and 26 are reached. This is achieved through all of the heating elements of the thermal heads 71, 72 and 73 having a predetermined resistance that differs between the thermal heads 71, 72 and 73. However, in a modification, all the heating elements may have an equal resistance, thereby requiring different heating times to be set between each of the plurality of heating elements of each thermal head (71, 72, 73).

When the image-forming sheet 10 is substituted for a temperature-sensitive sheet such as heat-sensitive paper, the printer works as an extremely high-speed thermal printer due to monochrome pixels being simultaneously generated on the heat-sensitive paper by the three thermal heads 71, 72 and 73.

When the CPU 60 receives mono-chromatic image data through the interface 62, the CPU 60 suitably controls the driver ICs 67, 68 and 69 so that the thermal heads 71, 72 and 73 form mono-chromatic lateral images simultaneously. The mono-chromatic image data is once stored in the memory 61, and the control signals DA1, DA2 and DA3 are output to the driver circuits 67, 68 and 69, corresponding to three partial lateral areas of the image data, respectively. The carriage driver 65 controls the motor 66 synchronously with the control of the thermal heads 71, 72 and 73.

Figure 10:
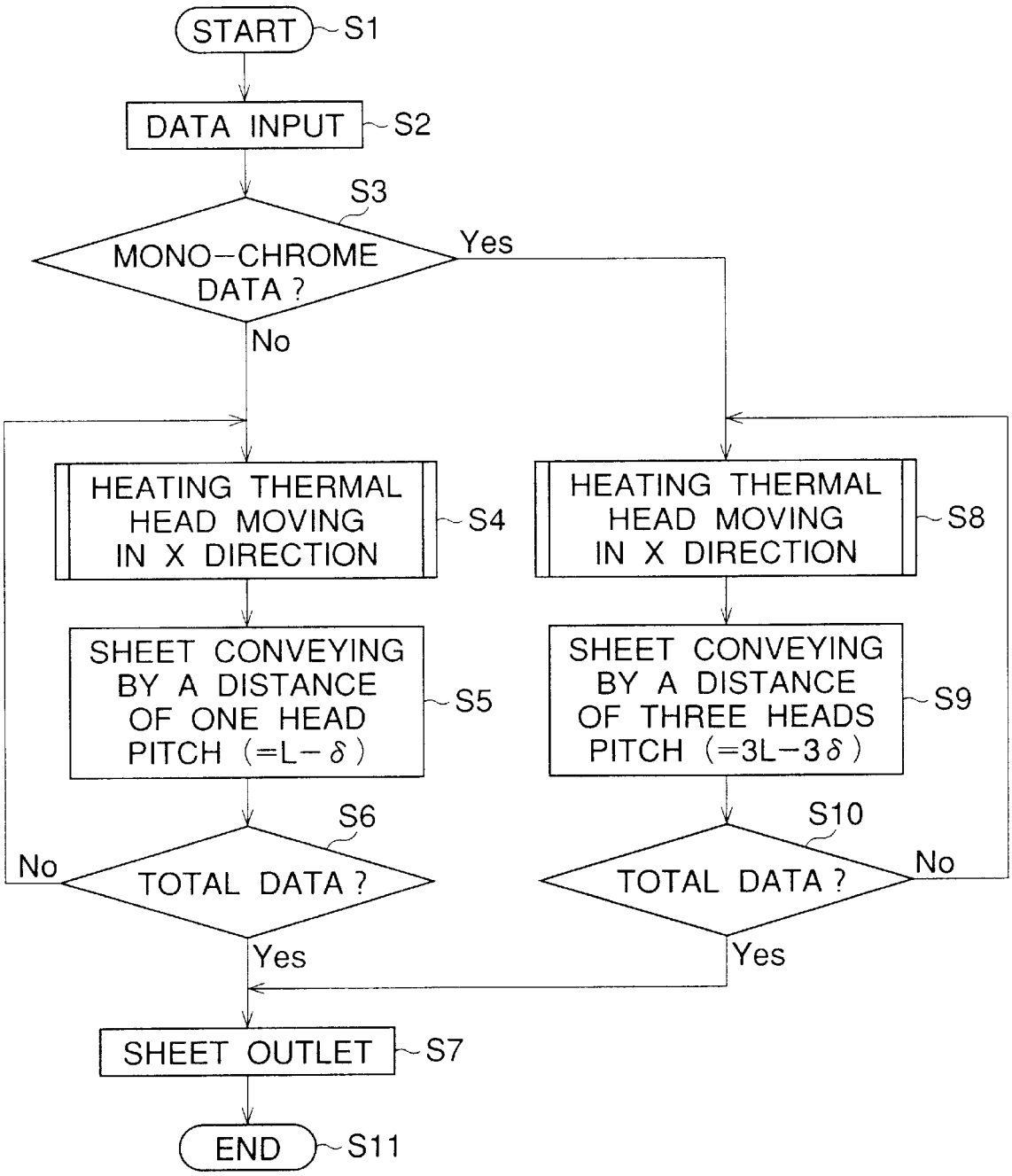
FIG. 10 is a flowchart showing a printing routine of the control system in FIG. 8.

FIG. 10 is a flowchart of a printing routine executed by the control circuit. Subsequent to the start step (S1), the digital image-pixel data of the image is input to the CPU 60 via the interface 62 at step S2. The CPU 60 judges whether the image to be printed is a color image or mono-chrome image according to the digital image-pixel data. When the image is a color image, steps from S4 to S6 are performed. At step S4, the thermal heads 71, 72 and 73 are heated and moved in the X direction for the color printing, as described previously, and at step S5, the image-forming sheet 10 is conveyed by the intermittant movement distance (L-δ) corresponding to one thermal head (71, 72, 73). Then, it is judged whether a total data has been processed at step S6. If the total data processing is completed, the image-forming sheet 10 is ejected from the printer 102 at step S7. When the image is a mono-chrome image, steps from S8 to S10 are performed. At step S8, the thermal heads 71, 72 and 73 are heated and printing commences in accordance with the control signals DA1, DA2 and DA3 while the carriage 70 is moved in the X direction for the mono-chrome printing on the heat-sensitive paper, and at step S9, the heat-sensitive paper is conveyed by a distance (3L-3δ) corresponding to three thermal heads (71, 72, 73). Then, it is judged whether the total data is processed at step S10. If the total data processing is completed, the heat-sensitive paper is ejected at step S7. And the process is finished (step S11).

When the carriage 70 has reached an end of the one printing movement in the line-printing direction X, the carriage 70 returns to a starting point in the reverse direction of the direction X. Simultaneously, the CPU 60 controls the conveyer roller motors 64A and 64B so that the image-forming sheet 10 is moved by a distance of (L-δ) or (3L-3δ), depending on the image-data input, for the printing of a next portion of the image.

When the mono-chrome printing is performed, it is also possible to perform printing during movement in the reverse direction of the direction X, as similarly mentioned with respect to the color printing.

Finally, it will be understood by those skilled in the art that the foregoing description is of preferred embodiments of the device, and that various changes and modifications may be made to the present invention without departing from the spirit and scope thereof.

The present disclosure relates to subject matters contained in Japanese Patent Application No. 10-73454 (filed on Mar. 6, 1998) which is expressly incorporated herein, by reference, in its entirety.

What is claimed is:

1. An image-forming system that records an image through selective heat and pressure application, comprising:

an image-forming sheet that includes a layer of a plurality of types of micro-capsules, each type of micro-capsule being squashed under a predetermined pressure and a predetermined temperature, said predetermined pressure and predetermined temperature of one type of micro-capsule being different from said predetermined pressure and predetermined temperature of other types of micro-capsules included in said layer, said image forming sheet being a pressure/temperature-sensitive sheet;

a conveyer that moves said image-forming sheet in a transport direction;

a plurality of thermal heads that correspondingly heat said types of micro-capsules to said predetermined temperature, said thermal heads extending in said transport direction and being staggeredly-aligned in said transport direction and in a line-printing direction perpendicular to said transport direction, such that an end of one of said thermal heads adjacently opposes an end of another of said thermal heads;

a pressure applying unit that selectively applies pressure to said micro-capsules corresponding to said predetermined pressure, a moving apparatus that moves said thermal heads in said line-printing direction; and a driving unit that controls each of said thermal heads by a control signal corresponding to a portion of said image to be developed by said each thermal head so that said each thermal head simultaneously develops said corresponding image portion.

2. The image-forming system of claim 1, wherein said adjacently opposed ends of said staggeredly-aligned thermal heads are separated in said line-printing direction by a separation distance, and overlap in said transport direction by an overlap distance.

3. The image-forming system of claim 1, wherein said pressure applying unit comprises said thermal heads, and each of said thermal heads applies a pressure on said micro-capsules, different from a pressure applied by said other thermal heads, and corresponding to a said predetermined pressure.

4. The image-forming system of claim 1, wherein a number of said thermal heads is three corresponding to colors of cyan, magenta and yellow.

5. The image-forming system of claim 1, wherein said thermal heads include a plurality of heating elements, a resistance of said heating elements being equal such that said each thermal head is configured to be independently controlled by a CPU to heat to said predetermined temperature.

6. The image-forming system of claim 1, wherein said each thermal head includes a plurality of heating elements having a predetermined resistance, said driving unit controlling said thermal heads to have equal heating times, said predetermined resistance of said heating elements of said each thermal head being selected to enable heating to a said predetermined temperature.

7. The image-forming system of claim 1, wherein said control signal comprises a strobe signal that determines a heating time of said thermal head and an image-pixel data signal corresponding to image-pixel data of said image.

8. The image-forming system of claim 1, wherein said each type of micro-capsule comprises a wall of glass-transition temperature and a thickness different from a glass-transition temperature and a thickness of said other types of microcapsules.

9. The image-forming system of claim 1, further comprising a determining unit that determines whether said image is one of a color image and a mono-chrome image.

10. The image-forming system of claim 9, wherein said conveyer is configured to move said image-forming sheet in said transport direction by a distance corresponding to three thermal heads when said determining unit determines that said image is a mono-chrome image, and said conveyer is further configured to move said image-forming sheet in said transport direction by a distance corresponding to one thermal head when said determining unit determines that said image is a color image.

11. The image-forming system of claim 1, further comprising a central processing unit that determines whether said image is one of a color image and a mono-chrome image.

* * * * *